US005722332A

United States Patent [19]

Fumanelli

[11] Patent Number: 5,722,332

[45] Date of Patent: Mar. 3, 1998

[54] APPARATUS AND PROCESS FOR CONDUCTING DEPOSIT AND DRAWING OPERATIONS OF BANKNOTES AND VALUABLES

[75] Inventor: Giuseppe Ezio Fumanelli, Melzo, Italy

[73] Assignee: M.I.B. Elettronica S.R.L., Peschiera Borromeo, Italy

[21] Appl. No.: 580,343

[22] Filed: Dec. 28, 1995

[51] Int. Cl.[6] ..... E05G 1/00

[52] U.S. Cl. ..... 109/45; 109/48; 109/66; 109/55

[58] Field of Search ..... 109/24.1, 66, 38–43, 109/45–49, 54–58

[56] References Cited

U.S. PATENT DOCUMENTS

| | | | |
|---|---|---|---|
| 895,581 | 8/1908 | Nygreen | 109/48 |
| 1,004,784 | 10/1911 | Hayes et al. | 109/48 X |
| 1,954,668 | 4/1934 | Ernst | 109/46 |
| 3,784,090 | 1/1974 | Markham | 109/66 X |
| 4,548,353 | 10/1985 | Howard et al. | 109/48 X |
| 4,643,107 | 2/1987 | Gunn et al. | 109/48 |
| 4,669,393 | 6/1987 | Wuthrich | 109/47 X |
| 4,696,426 | 9/1987 | Decker et al. | 109/24.1 X |
| 4,724,774 | 2/1988 | Wiedemar et al. | 109/48 |
| 4,755,011 | 7/1988 | Seroka et al. | 109/47 X |
| 4,838,480 | 6/1989 | Takahashi et al. | 109/24.1 X |
| 4,884,679 | 12/1989 | Graef et al. | 109/55 X |
| 4,997,176 | 3/1991 | Hain | 109/24.1 X |
| 5,016,546 | 5/1991 | Haueter | 109/45 |
| 5,172,643 | 12/1992 | Koshida et al. | 109/66 X |
| 5,301,618 | 4/1994 | Abendschein et al. | 109/55 |
| 5,464,200 | 11/1995 | Nakazato et al. | 109/57 X |
| 5,488,913 | 2/1996 | Fumanelli | 109/45 |

FOREIGN PATENT DOCUMENTS

| | | | |
|---|---|---|---|
| 0 604 880 A2 | 7/1994 | European Pat. Off. . | |
| 344460 | 9/1920 | Germany | 109/48 |
| 1449020 | 1/1969 | Germany . | |
| 2829532 | 10/1979 | Germany | 109/48 |
| 3136610 | 3/1983 | Germany . | |

OTHER PUBLICATIONS

IBM Technical Disclosure Bulletin, vol. 31, No. 3, Aug. 1988, Armonk NY, USA, pp. 432–433, XP002004216, "Easily Accessible Bill Dispense Box".

*Primary Examiner*—Suzanne Dino
*Attorney, Agent, or Firm*—Browdy and Neimark

[57] ABSTRACT

An apparatus comprising a protective envelope (2) having one aperture (3), casings (4) for banknotes and valuables (5), support and movement members (6) engaging the casings (4) and adapted to impose a first movement along a selection path to said casings, and electronic control means (9), the casings (4) being movably in engagement with the support and movement members (6) in a direction transverse to the selection path, and translation members (10) being also arranged which are adapted to impose a second movement to the casings (4), which is transverse to the selection path and passes at least close to the aperture (3), to make the casings (4) accessible for deposit and drawing operations manually carried out through the aperture (3).

14 Claims, 4 Drawing Sheets

APPARATUS AND PROCESS FOR CONDUCTING DEPOSIT AND DRAWING OPERATIONS OF BANKNOTES AND VALUABLES

BACKGROUND OF THE INVENTION

The invention relates to an apparatus and process for conducting deposit and drawing operations of banknotes and valuables.

It is known that for protection of banknotes and valuables, either a traditional safe or the like can be used or other apparatus such as that described in the European Patent Application publication No. EP-A-604880corresponding to U.S. Pat. No. 5,488,913.

The traditional safe however represents a hindrance when frequent deposit and drawing operations are carried out, such as in banks for example, whereas the apparatus of said U.S. patent, while ensuring maximum safety, also facilitates all deposit and drawing operations.

It comprises a protective envelope provided with apertures for depositing and drawing banknotes and affording a plurality of internal casings for the banknotes. The casings are movable and selectively brought to positions in register with the envelope apertures, by movement means submitted to suitably programmed electronic control members. Within the envelope, the casings can be easily opened and therefore, in order to avoid the banknotes being drawn in an illicit manner, by introduction of hands into the apertures for example, said apertures are protected by electronically-controlled movable safety partitions. Banknotes are then distributed by appropriate ejecting members causing the banknotes housed in the casings to be moved forward towards the drawing point. While this new apparatus is advantageous and satisfactory in some aspects, it also has some drawbacks. In fact, the safety requirements impose the presence, control and movement both of said safety partitions and ejecting members.

This complexity affects costs increasing them and therefore represents a hindrance to the apparatus spreading. Due to the mechanical distribution of the banknotes, they need to be supplied as much as possible in a very orderly manner.

In addition, the inner casings become accessible when for any reason protection of said movable partitions is not working and in any case the protective envelope is the only protection cover therein provided.

SUMMARY OF THE INVENTION

Under this situation, the aim underlying the present invention is to essentially obviate the above mentioned drawbacks.

This aim is substantially achieved by an apparatus for conducting deposit and drawing operations of banknotes and valuables comprising: a protective envelope having at least one aperture, a plurality of casings for banknotes and valuables located within said protective envelope, support and movement members engaging said casings and adapted to impose a first movement along a selection path to said casings, and electronic control means, said casings being movably in engagement with said support and movement members, in a transverse direction relative to said selection path, and translation members being arranged, which are adapted to impose to said casings a second movement transverse to said selection path and passing at least close to said at least one aperture, to make said casings accessible to deposits and drawings manually executed through said at least one aperture.

BRIEF DESCRIPTION OF THE DRAWINGS

Description of a preferred embodiment of the invention is now given hereinafter, by way of example, illustrated in the accompanying drawings, in which.

DETAILED DESCRIPTION OF THE INVENTION

Figure 1:
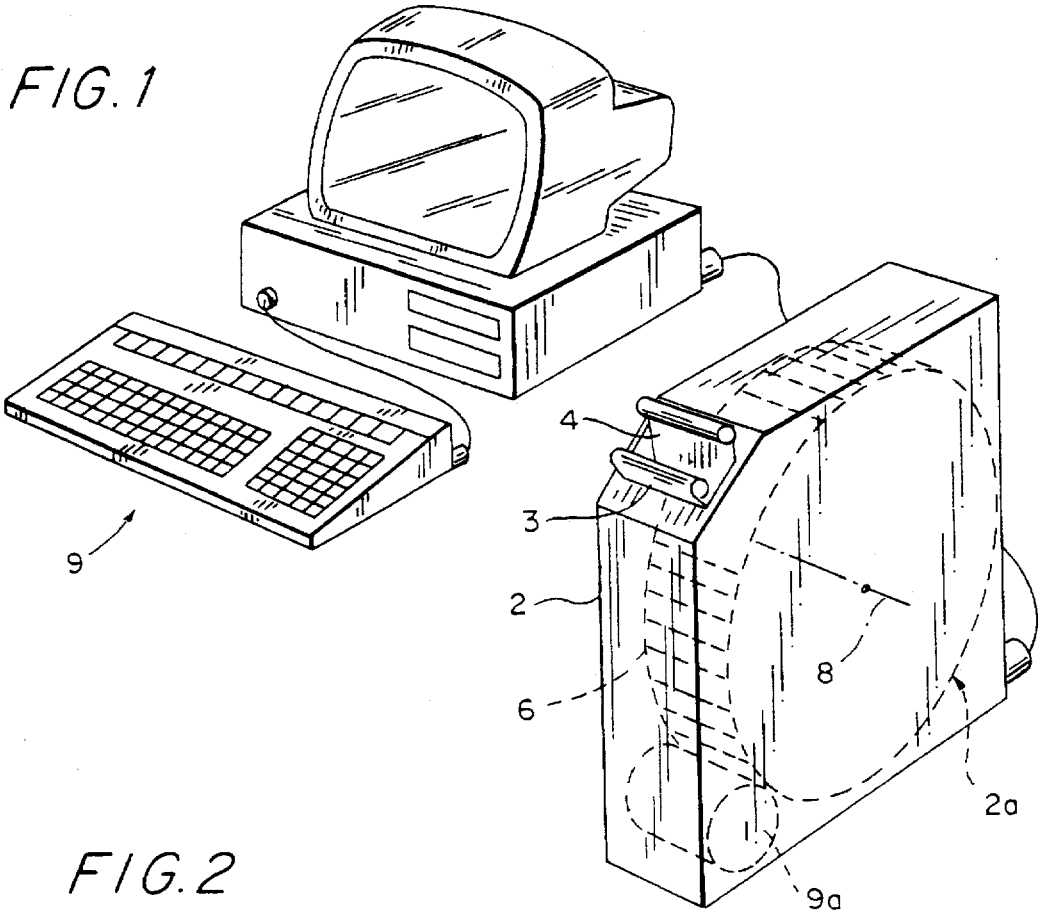
FIG. 1 is a a perspective view of the apparatus taken as a whole, with a casing located close to a deposit and drawing aperture.
Figure 2:
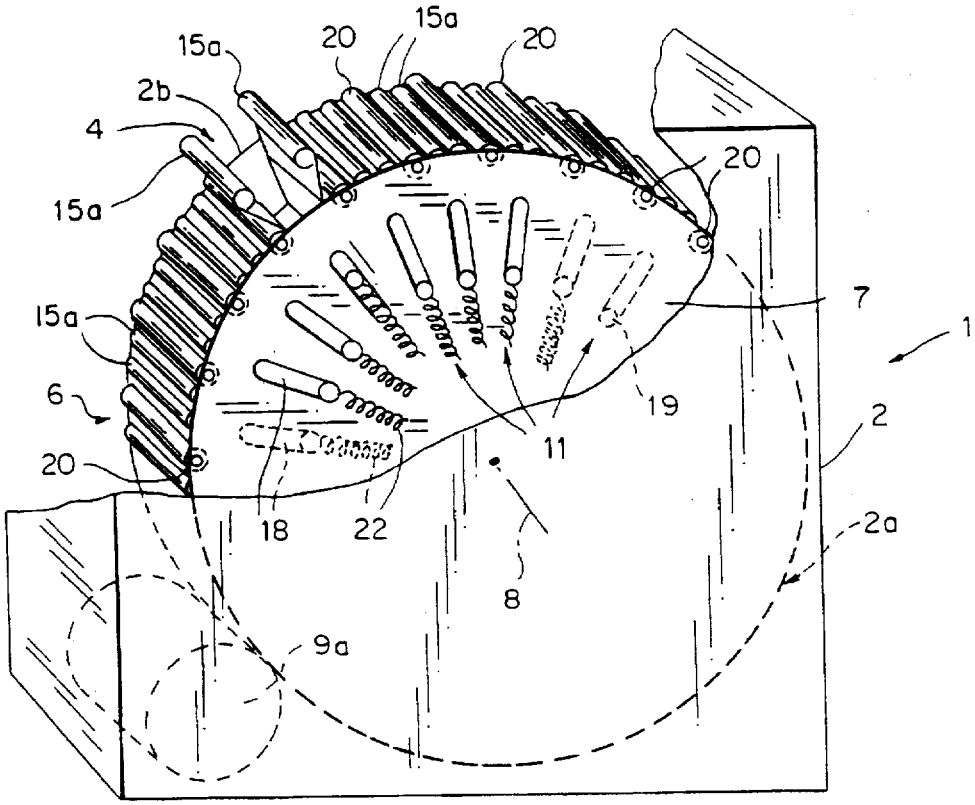
FIG. 2 is a cut-away view in perspective of a portion of the apparatus shown in FIG. 1.

With reference to the drawings, the apparatus according to the invention is generally denoted by 1. It comprises a protective envelope 2 having features of high strength and provided with at least one aperture 3. In the preferred solution only one aperture 3 exists for introduction and distribution of banknotes and valuables. The protective envelope 2 internally has a plurality of casings 4 adapted to hold banknotes or valuables 5. Casings 4 are disposed at consecutive positions with respect to each other, so as to form a ring, a circular ring in particular, and are subjected to two completely differentiated movements.

A first movement extends along a ring-shaped selection path, in particular of circular form, defined by the arrangement of casings 4.

A second movement extends in a direction transverse to the first movement and in particular at right angles to the selection path, in a radial direction.

In detail, casings 4 are supported and guided by support and movement members 6 comprising two circular stiff plates 7, parallel to each other, between which the casings 4 are fitted. For accomplishment of the first movement, plates 7 are rotatably engaged, at a rotation axis 8, within the protective envelope 2 and are moved by an electric motor 9*a* interlocked to electronic control means 9, known per se. The second movement, which is radial to the rotation axis 8, is made possible because casings 4 are movably in engagement with the support and movement members 6 and because translation members 10 are present which are interlocked to the electronic control means 9 as well.

The translation members 10 are adapted to translate at least one casing 4 towards the access opening 3 when said casing is at a predetermined transferring position 2*b* located along said selection path.

Figure 3:
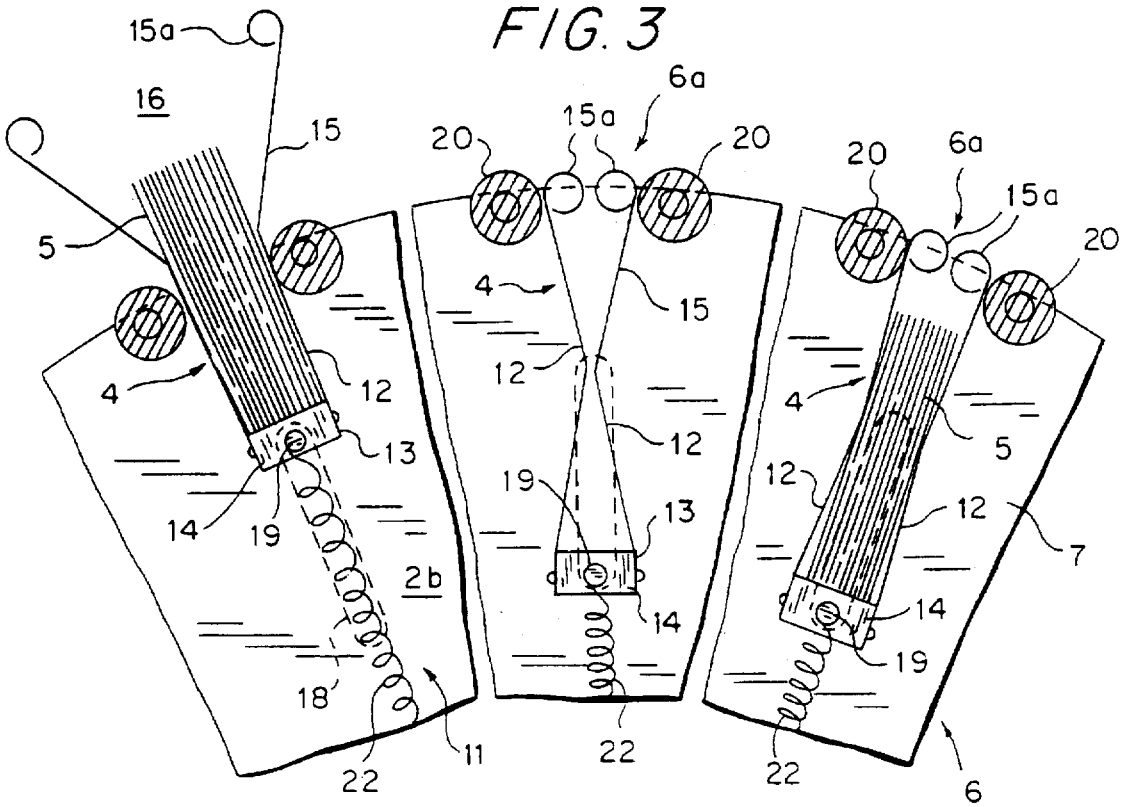
FIG. 3 shows some casings of the apparatus, in several different positions.
Figure 3A:
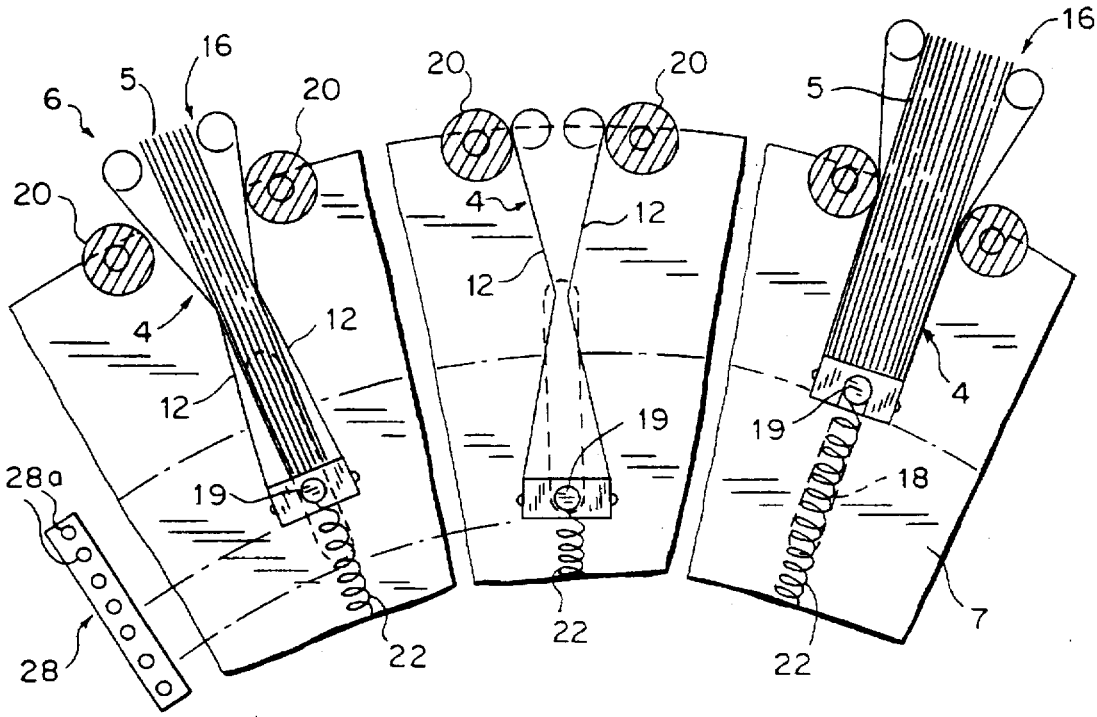
FIG. 3*a* shows how some casings of the apparatus are arranged in a particular embodiment of said apparatus.

For example, the transferring position 2*b* is the selection path point which is the closest to the aperture 3. During this second movement too the casings 4 are still in engagement with the support and movement members 6 within which guide channels 6a are defined, along said channels each casing 4 being able to translate between two positions: a transversely advanced position located close to the aperture 3 and a transversely retracted position, spaced apart from the aperture 3. The translation members 10 comprise guide elements 11, formed in the support and movement members 6 enabling translation of casings 4 between a transversely advanced position projecting from the plate 7 edges, and a transversely retracted and protected position, buried between the plates 7, as best shown in FIGS. 3 and 3*a*.

Before going on describing the guide elements 11, full details are immediately given about the casing 4 structure. Each casing 4, on its opposite sides, is comprised of two flaps 12 made of resilient material and such positioned that they tend to spread apart spontaneously.

Flaps 12 are provided with attachment areas 13 for connection to a base body 14 and wide apart portions 15 terminating with closure elements or reliefs 15*a* at an aperture or mouth 16. The closure elements or reliefs 15 face each other and enable the mouth 16 to be completely occluded when the wide apart portions 15 are sufficiently close to each other.

Preferably, each flap 12 is divided into two sections, so as to emphasize the resiliency of same at each point and has a hollow 17 to facilitate gripping of the contents of a casing The position of flaps 12 is imposed by said guide elements 11 causing opening and closure of casings 4 simultaneously with positioning of the latter in a radial direction with respect to the rotation axis 8.

In fact, the guide elements 11 are comprised of radial elongated holes 18 formed in the plates 7 and adapted to house pins 19 or similar elements projecting from the base bodies 14, and crosspiece-like elements 20 consisting of bars of circular section transverse to the plates 7, for example. The crosspiece-like elements 20 join plates 7 to each other defining said guide channels 6*a* therewith and are such positioned that they cause the shaped portions 15 to be forcedly moved close to each other during movement of casings 4 from said advanced to said retracted positions.

Essentially, the crosspiece-like elements 20 fix the distance between flaps 12 as a function of the radial position of the casing 4 itself, and when said casings are in the retracted position they preferably impose approaching until contact of the closure reliefs 15*a* .

Practically, casings 4 in the retracted position are closed and protected not only by the protective envelope 2, but also by a second envelope 2*a* (FIG. 9) formed of the plates 7 and crosspiece-like elements 20.

Figure 4:
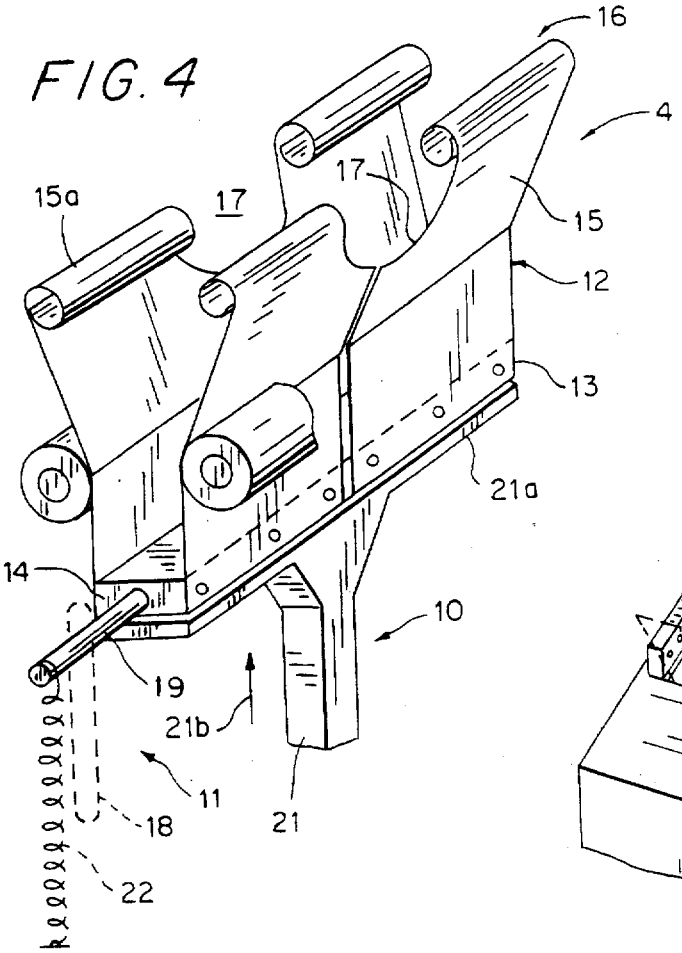
FIG. 4 is a perspective view of a casing during the displacement step towards said aperture.
Figure 5:
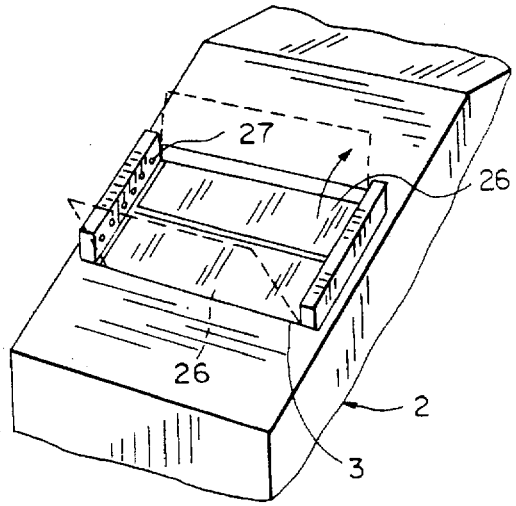
FIG. 5 shows a portion of the apparatus close to said aperture and accident-prevention elements provided at said aperture.

Said translation members 10 are at least partly disposed either between the plates 7 or outside of the latter. When the translation members 10 are disposed between the plates 7, they are comprised of a pusher 21, actuated by an air cylinder for example, or by a screw-nut screw coupling, and having an end plate 21*a*. The pusher 21 is operated according to arrow 21*b* in FIG. 4, so that the end disc 21*a* is capable of pushing a base body 14 of a casing 4 at the transferring position 2*b*, located along said selection path, from said retracted position to said advanced position, close to the aperture 3, while the pins 19 of the casing 4 slide in the radial holes 18 of the plates 7.

Preferably in said advanced position casings 4 partly jut out of the aperture 3 (FIG. 1) and are open, as already seen, so that an easy and immediate manual access to the inside of same is enabled.

In order to bring the casings 4 from the aperture 3 back to the inside of the second envelope 2*a*, when pusher 21 moves backward, return devices 22 defined by springs active on the pins 19 are provided.

Figure 7:
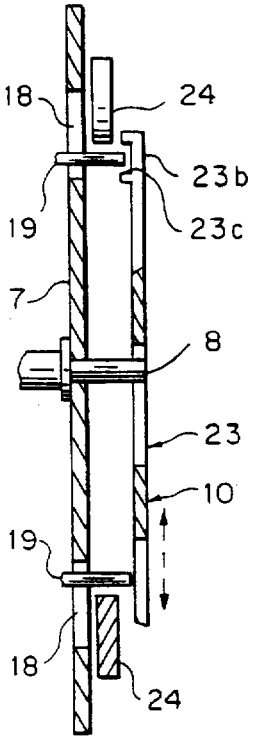
FIG. 7 is an elevational side view, only partly in section, of translation members for the casings.
Figure 8:
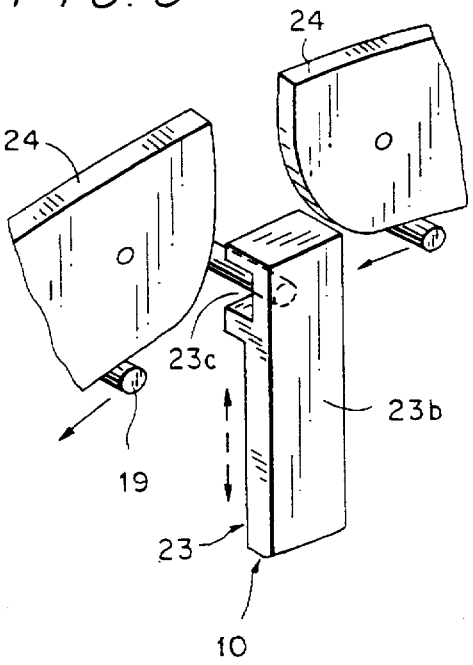
FIG. 8 is a perspective view of a detail of the translation members shown in FIG. 7.
Figure 9:
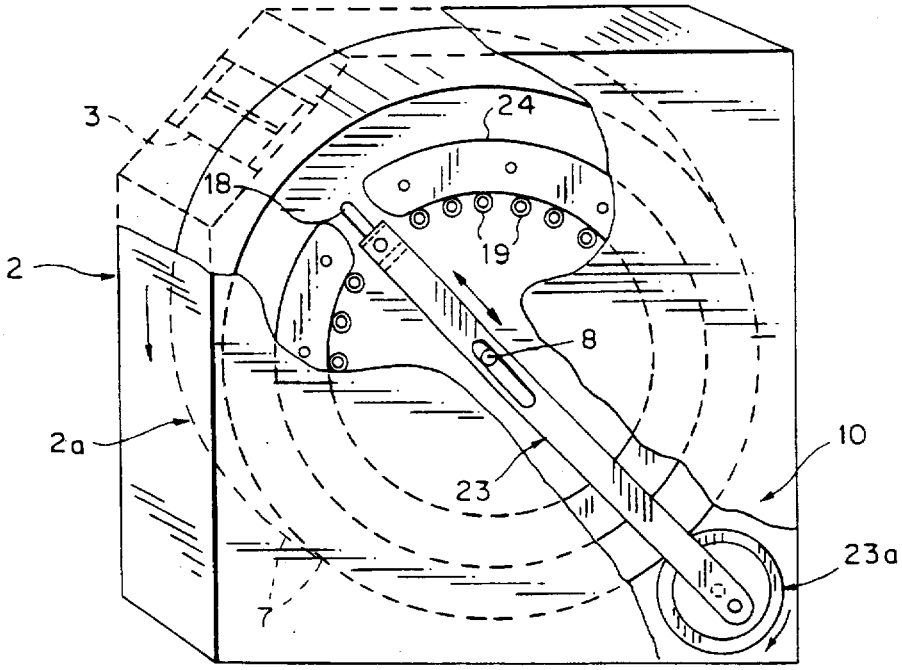
FIG. 9 is a cut-away perspective view of a portion of the apparatus showing said translation members together with locking elements for the casings.

When the translation members 10 are located externally of plates 7, they have at least one swinging bar 23 (FIG. 9), structured for example as a movable connecting rod submitted to the action of a drive crank gear 23*a* or equivalent mechanis to move generally diametrically with respect to the plates 7 as indicated by the double arrow in FIGS. 7, 8 and 9.

Bar 23, at its end opposite to the drive crank gear 23*a*, is provided with a working element 23*b* adapted to engage a pin 19.

In fact, the working element 23*b* is provided to have, on its side facing the respective plate 7, a transverse channel 23*c*, extending circumferentially with respect to the axis 8 and adapted to allow passage of pins 19 driven in rotation together with plates 7, if the working element 23*b* is in its position of maximum approaching to axis 8 and the gear 23*a* is in its rest position shown in FIG. 9, and, on the contrary, to engage said pins 19 and move them both in a centrifugal and a centripetal direction, when the drive crank gear 23*a* is operated.

Casings 4 are held within the second envelope 2*a*, when transferring of same towards the aperture 3 is not operated, by appropriate locking devices, preferably acting on pins 19. Said locking devices are comprised in particular of a fixed cam 24 extending circumferentially close to the plate 7. The fixed cam 24 is cut out at the transferring position 2*b* to enable radial movement of the pins 19 when the bar 23 acts on the pins 19 of the casings 4, as shown in FIG. 8.

Figure 6:
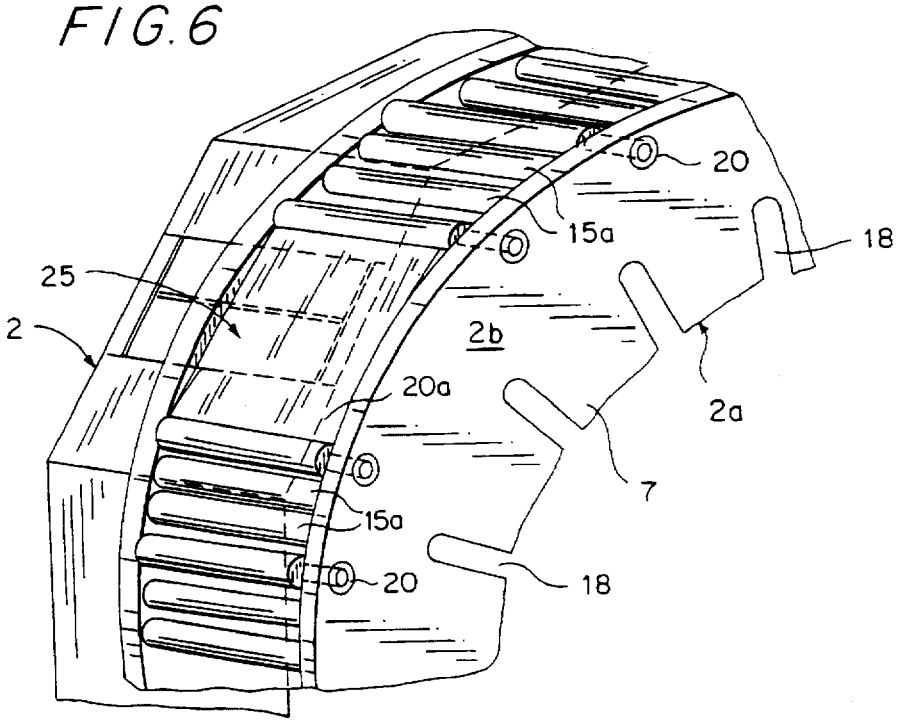
FIG. 6 is a fragmentary perspective view showing how the apparatus is arranged in the periods of non-use of same.

In addition, the electric motor 9*a*, or another appropriate device, prevents rotations of the second envelope 2*a* which are not enabled by the electronic control means 9. To increase safety, provision is made between the plates 7 for a blind area 25 which is devoid of casings 4 and engaged by an occlusion plate 20*a* (FIG. 6).

The blind area 25 together with the occlusion plate 23*a* is located in the transferring position 2*b* when the apparatus is not used over a certain period of time, based on detections or commands by the electronic control means 9.

The positions of casings 4 which are protected and closed within the second envelope 2*a*, makes it substantially useless to arrange a movable safety partition at the aperture 3 and said aperture 3 is provided to be completely free or only partly occupied by doors having an accident-prevention function.

For example, freely pivoted tipping over covers 26 are provided, the rotation to opening of which is directly carried out, by direct interference or thrust, by the casings 4 engaging the aperture 3.

To increase the accident-prevention safety, photoelectric cells 27 may be provided on the aperture edges, which cells are responsive to the presence of a hand and capable of locking the apparatus. Obviously, the photoelectric cells 27 are deactivated by the electronic control means 9 when the aperture 3 is engaged by a casing 4.

The apparatus may be equipped with several sensors and control means so that all operations are made automatically.

In particular, it is pointed out that a specific embodiment of the invention can be made, as shown in FIG. 3*a*, which is provided of new means 28 for detecting the presence and amount of banknotes 5 in each casing 4.

In this specific embodiment, casings 4 are completely buried between plates 7 only when they are empty.

The detection means 28 have sensors 28*a* responsive to the radial position of a casing 4 and therefore responsive to the spreading-apart degree of flaps 12, related to the amount of the banknotes therein present.

Operation of the apparatus is as follows. First, filling of at least part of casings 4 is executed, and deposit operations are carried out by inserting banknotes into the casings themselves, which are made accessible in succession at the aperture 3.

In fact, the support and movement members 6 move the casings 4 along said selection path so as to enable passage of casings 4 one at a time by the transferring position 2*b*, internally of the second envelope 2*a* and protected.

The translation members 10 act on each casing 4 in the transferring position 2*b* making it move radially forward until the aperture 3.

In such a position the wide apart portions 15 of flaps 12 which are not opposed by the crosspiece-like elements 20, move apart from each other widening the mouth 16 to the greatest degree, in order to facilitate manual introduction of also loose banknotes or valuables.

At the end of each deposit operation, the return devices 22 or working device 23*b* force the casing 4 located close to the aperture 3 to return to the inside of the second envelope 2*a*. During this return operation, the crosspiece-like elements 20 push the flaps 12 externally and therefore cause the wide apart portions 15 to approach each other, preferably as far as they close the casings 4.

The electronic control means 9 records the amount of money introduced into each casing 4, in view of the following drawing operations.

In addition, appropriate detection means may intervene to confirm and/or determine the contents of each casing 4. In the particular case shown in FIG. 3*a*, the banknotes 5 are oriented so as to engage the casing mouth 16 to, and therefore the admitted amounts force the flaps 12 to an arrangement according to a different mutual distance causing a different retraction degree of the casings between the plates 7. The detection means 28 measures this retraction degree and supply indications about the banknote amounts in each casing 4.

When the initial deposit operations have been completed, drawing operations may be carried out: the electronic control means 9 acts on the support and movement members 6 so that, positioned each time at the transferring position 2*b*, is the casing 4 which, based on the recorded information, has the required money amount inside it, or an amount immediately higher.

Then said casing 4 is disposed within reach of the person assigned to the drawing operations, a bank cashier for example, thanks to the translation members 10 moving the casings 4 from the transferring position 2*b* to the aperture 3.

During intervention of the translation members 10 the spontaneous spreading apart of flaps 12 occurs, the casings 4 being completely opened.

If necessary, for one and the same drawing operation, several casings 4 in succession may intervene, so that all the required money amount will be available.

Drawings can be alternated with deposits and in this case casings 4 that may have been left empty or have been emptied due to drawings are made available by the electronic control means 9.

A consecutive execution of both drawing and deposit operations can be suitable also for the purpose of redepositing the change, that is the money amounts drawn in excess. If changes are not redeposited, the electronic control means 9 can carry out subsequent reduced money distributions, that is curtailed of the chances that have not been redeposited.

When the apparatus of the invention is not in operation, or during inactivity or halt periods, the blind area 25 together with the occlusion plate 23*a* is provided to be disposed at the transferring position 2*b*, so as to achieve a further protection of the second envelope 2*a* at the area thereof which is the closest to the aperture 3.

The above described apparatus of the invention puts into practice a process consisting of imparting two distinct movements to the casings internal of the protective envelope. The first movement consists in moving the casings along a selection path which is protected and not accessible from the protection envelope aperture.

This first movement of the casings aims at arranging the most appropriate casing to a predetermined transferring position.

The second movement is carried out transversely of the first one and in a direction passing by said transferring position and the protection envelope aperture.

This second movement aims at making the casing previously brought to the transferring position easily accessible from said aperture, for a comfortable manual drawing or deposit.

Thus, easy manual operations involving drawing or insertion even of loose money are possible, as well as moved-away and protected positioning of the remaining casings.

In addition, the process not only offers the facility of protecting each casing when in the transferring position, but also preferably enables it to be kept closed too, while, on the contrary, the same casing is disposed open at said aperture.

To this end an auxiliary opening or closing movement is imposed to each casing.

This auxiliary movement is provided to take place simultaneously with said second movement, so that at the end-of-stroke positions each casing has already been opened or closed, without the occurence of delays.

In addition, the auxiliary movement is carried out transversely of the second movement, so as not to hinder said second movement, and consists of a spontaneous spreading apart or forced approaching of movable parts of the casings.

Practically the auxiliary movement is interlocked to said second movement.

The invention achieves important advantages. The apparatus is of simple structure and therefore of high reliability and low cost.

In addition, the apparatus is adapted to increase the money flow rate of a bank counter for example, during both the deposit and drawing (i.e. banknote distribution) steps. In fact, the radial sliding of the casings enables the latter to be placed to a comfortable position for the cashier's hand.

This comfort is greatly increased and represents an important and very agreeable feature of the apparatus of the invention, In addition, the radial retraction of the casings and closure of same within the second envelope 2*a* enables an increased sure safekeeping of the valuables therein contained.

The safety degree is such that it is not necessary to arrange a safety closure at the access aperture 3, which makes the apparatus still simpler.

It should be also noted that the flexibility and closed and protected position of said casings within the second envelope 2*a* allows the same to be maintained tightly close to each other, so that practically the maximum part of the room between the plates 7 is utilized.

As a result, the apparatus has a very important capacity, even when the external sizes thereof are not very large. This storage feature too is particularly appreciated by users, in that a prolonged work independence is allowed.

I claim:

1. An apparatus for conducting deposit and drawing operations of banknotes and valuables, comprising:

a protective envelope (2) having at least one aperture (3), a plurality of casings (4) for banknotes and valuables (5) located within said protective envelope (2), support and movement members (6) engaging said casings (4) for imposing to said casings (4) a first movement along a closed selection path, said casings (4) movably engaging said support and movement members (6), translation members (10) for imposing to said casings (4), at said at least one aperture (3), a second movement transverse to said selection path, to bring a selected one of said casings (4) into a transversely advanced position in which said selected one of said casings (4) is accessible through said at least one aperture (3), and electronic control means (9) for operating said support and movement members (6) and said translation members (10).

2. An apparatus according to claim 1, wherein said support and movement members (6) have guide channels (6*a*) extending transverse to said selection path, said casings (4) being movable in said guide channels (6*a*) between said transversely advanced position and a transversely retracted position.

3. An apparatus according to claim 1, wherein said support and movement members (6) house said casings (4) in a substantially closed and protected position, and substantially form a second envelope (2*a*) within said protection envelope (2).

4. An apparatus according to claim 1, wherein each of said casings (4) comprises one base body (14), one mouth (16) and at least two opposite flaps (12) movable apart from each other and extending between said base body (14) and said mouth (16), and wherein said flaps (12) are made of a resilient material forcing said flaps (12) to spread apart.

5. An apparatus according to claim 1, wherein said support and movement members (6) comprise two stiff plates (7) disposed in side by side relationship and rotatable about a rotation axis (8), crosspiece-like elements (20) joining said plates (7) together, and elongated holes (18) formed in said plates (7) and extending in a direction radial to said rotation axis (8), and wherein said casings (4) are insertable between said plates (7) and crosspiece-like elements (20) and said casings (4) have pins (19) integral with said casings (4) and slidably fitted in said elongated holes (18) for allowing said second movement of said casings (4).

6. An apparatus according to claim 5, wherein each of said casings (4) comprises two opposite flaps (12) made of resilient material forcing said flaps (12) to spread apart from each other, and wherein said crosspiece-like elements (20) cause a mutual approaching of said flaps (12) by externally acting on said flaps (12) when said casings (4) are completely fitted between said plates (7).

7. An apparatus according to claim 1, wherein said translation members (10) comprise at least one pusher (21) for selectively causing advancing of one of said casings (4) toward said at least one aperture (3), and return devices (22) active in an opposite direction with respect to said pusher (21).

8. An apparatus according to claim 1, further comprising pins (19) integral with said casings (4), and elongated holes (18) formed in said support and movement members (6) and slidably engaged by said pins (19), and wherein said translation members (10) comprise a swingable bar (23) selectively engageable with said pins (19) for translating a selected one of said casings (4).

9. An apparatus according to claim 1, wherein said casings (4) comprise pins (19) externally projecting from said casings (4), and wherein the apparatus further has locking devices for said casings (4), said locking devices comprising at least one fixed cam (24) active on said pins (19).

10. An apparatus according to claim 1, further comprising a blind area (25) between said casings (4), said area facing said translation members (6) when the apparatus is inoperative.

11. An apparatus according to claim 1, wherein said casings (4) comprise each two opposite flaps (12) made of resilient material forcing said flaps (12) to spread apart from each other, and wherein the apparatus further comprises detection means (28) for detecting the banknote amount in each of said casings (4), said detection means having sensors (28*a*) for sensing a position of each of said casings (4) in a direction transverse to said selection path and a related spacing apart of said flaps (12).

12. A process for conducting deposit and drawing operations of banknotes and valuables in an apparatus comprising a protective envelope provided with at least one aperture and internally having casings for holding banknotes and valuables, the process comprising the steps of:

imposing to said casings a first movement along a closed selection path, to arrange a selected one of said casings at a predetermined transferring position along said selection path which is inaccessible from said at least one aperture, imposing to said selected one of said casings in said transferring position a second movement which is transverse to said selection path, for bringing said selected one of said casings into a transversely advanced position in which said selected one of said casings is accessible through said at least one aperture, and returning said selected one of said casings to said transferring position on said selection path.

13. A process according to claim 12, wherein said selected one of said casings is kept closed at said transferring position and is kept open in said transversely advanced position at said aperture, and wherein an auxiliary opening movement is imposed to said selected one of said casings.

14. A process according to claim 13, wherein said auxiliary opening movement extends transverse to said second movement and is carried out simultaneously therewith.

* * * * *